United States Patent [19]

Geschwindner

[11] Patent Number: 4,469,321

[45] Date of Patent: Sep. 4, 1984

[54] DEVICE FOR THE DELAYED PILING OF SHEETS

[75] Inventor: Herbert Geschwindner, Wachtersbach, Fed. Rep. of Germany

[73] Assignee: M.A.N.-Roland Druckmaschinen Aktiengesellschaft, Fed. Rep. of Germany

[21] Appl. No.: 359,191

[22] Filed: Mar. 18, 1982

[30] Foreign Application Priority Data

Mar. 30, 1981 [DE] Fed. Rep. of Germany ..... 3112558

[51] Int. Cl.[3] ..... B65H 29/68; B65H 31/12

[52] U.S. Cl. ..... 271/183; 271/189; 271/192; 271/218

[58] Field of Search ..... 271/189, 183, 192, 218

[56] References Cited

U.S. PATENT DOCUMENTS

| | | | |
|---|---|---|---|
| 2,643,757 | 6/1953 | Kovatch | 271/192 X |
| 3,966,195 | 6/1976 | Simeth | 271/189 |
| 3,966,196 | 6/1976 | Simeth | 271/218 |

FOREIGN PATENT DOCUMENTS

| | | | |
|---|---|---|---|
| 7509635 | 11/1976 | Netherlands | 271/218 |

*Primary Examiner*—Richard A. Schacher

*Attorney, Agent, or Firm*—Leydig, Voit, Osann, Mayer & Holt, Ltd.

[57] ABSTRACT

A device for the delayed piling of sheets in a delivery mechanism of a sheet fed printing press to provide time for the insertion of a temporary receiving tray as a filled pile board is removed and replaced by an empty pile board. A buffer storage device is located immediately above the support for the receiving tray for intercepting sheets entering the receiving space. The buffer storage device includes a front edge support for supporting the front edge of a sheet and a rear edge support for supporting the rear edge of the sheet. At least the rear edge support, which occupies a normal horizontal position, has a hinge mounting but is lightly counterbalanced so that the first few sheets, upon making a pile change, are intercepted providing a time delay for insertion of the receiving tray, but with the accumulated weight of the first few sheets being sufficient to overcome the counterbalancing force so that the intercepted sheets, following the time delay, are automatically dumped as a group upon the tray. In the preferred form of the invention the rear support is of dog-leg cross section having a horizontal support leg and a generally vertical counterbalancing leg with a pivot axis between them. Also in the preferred embodiment a sheet brake assembly is mounted on the frame adjustably positionable for accommodating sheets of different length, with the rear edge support being hinged to the subassembly for simultaneous adjusting movement therewith.

6 Claims, 4 Drawing Figures

DEVICE FOR THE DELAYED PILING OF SHEETS

In a modern high production sheet fed printing press the printed sheets form a pile in the delivery mechanism. During the course of a long run the pile reaches maximum height and must be removed from time to time. It is obviously desirable to keep the press running at full speed so that there will be no loss of production during pile changing. This requires that a temporary support be interposed in the sheet receiving space to intercept the sheets until a fresh pile board is in readiness. This function is conventionally performed by a temporary receiving tray. However, it takes time to lower the pile sufficiently to enable the receiving tray to be inserted into position, and during this time several sheets may be delivered.

As a result relatively elaborate schemes have been devised to intercept delivered sheets until a filled pile board can be removed and a fresh pile board installed, for example, as disclosed in German patent publication No. 2 301 840.

It is an object of the present invention to provide, in a delivery mechanism for a sheet-fed printing press, an initial, or buffer, storage device which intercepts the first few sheets fed following the lowering of the pile to provide a time delay for insertion of a temporary receiving tray but in which the storage device, following the time delay, acts automatically to dump the sheets as a group upon the tray. It is a related object of the invention to provide an initial, or buffer, storage device which is of simple, inexpensive and light construction and which empties itself automatically in response to the weight of only a few collected sheets to provide a time delay of predetermined length. It is a general object of the invention to provide automatic means for achieving a predetermined short time delay in the feeding of sheets during changing of a pile which, notwithstanding the light actuating forces, acts positively and reliably and which is capable of operating with only occasional maintenance for long periods of time.

It is another object of the present invention to provide a buffer storage device including front and rear edge supports and in which at least the rear edge support has a hinge mounting and in which the hinge is supported upon an associated sheet brake for simultaneous adjusting movement therewith to accommodate the delivery mechanism to sheets of differing length.

Other objects and advantages of the invention will become apparent upon reading the attached detailed description and upon reference to the drawings in which.

Figures 1, 2, 3, 4:
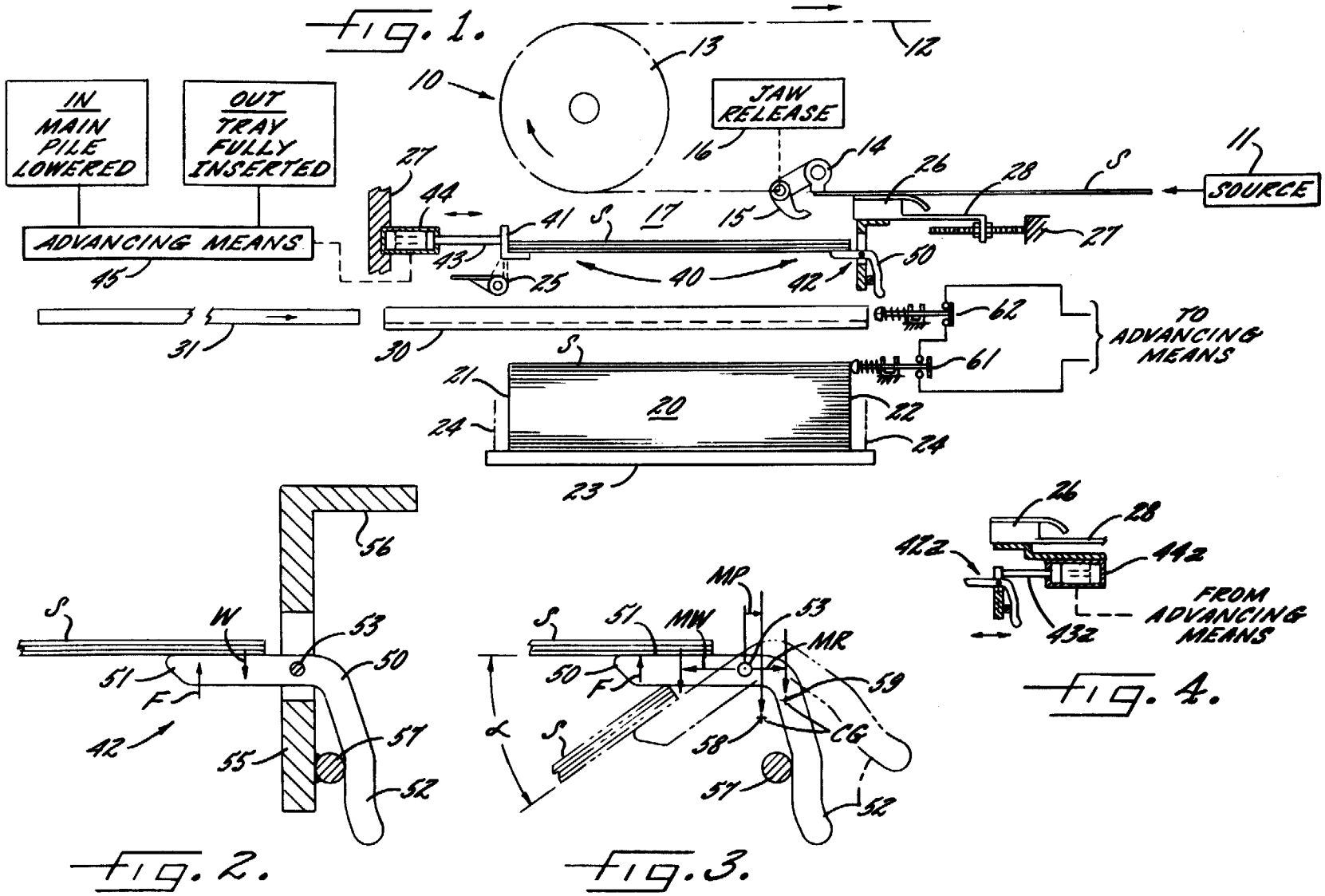
FIG. 1 is a diagrammatic view, in elevation, of a printing press delivery mechanism constructed in accordance with the present invention.
FIG. 2 is a fragmentary elevational view based upon FIG. 1 but showing the rear edge support somewhat enlarged.
FIG. 3 is a diagram showing the rear edge supporting member in respective supporting and dumping positions.
FIG. 4 is a fragmentary elevational view showing means for optionally retracting the rear edge support.

While the invention has been described in connection with certain preferred embodiments, it will be understood that there is no intention to limit the invention to the particular embodiments shown but it is, on the contrary, the intention to cover the various alternative and equivalent constructions included within the spirit and scope of the appended claims.

Turning now to FIG. 1 of the drawings there is shown a delivery mechanism 10 which is fed with sheets S from a source 11 which is, conventionally, a multi-color press. These sheets are fed on a conveyor chain 12 which is trained about a drum 13. Spaced along the length of the conveyor chain are grippers 14 having respective jaws 15 which grip the leading edge of the sheet.

As the sheets enter the delivery station the grippers encounter a jaw release mechanism 16 which opens the jaw. The sheet, carried forward by its momentum, settles downwardly through a receiving space 17 under the force of gravity onto a pile 20 having a front edge 21 and a rear edge 22 supported upon a pile board 23 having a suspension 24. During its course of forward and downward movement the front edge of the sheet is blocked by a front stop 25 so that all of the sheets are aligned with one another in a neat monolithic pile.

For the purpose of dissipating excess forward momentum, each sheet is engaged, on its underside, by a sheet brake 26. Such brake may, for example, be of conventional type in which vacuum is applied to suck the sheet down into engagement with a friction surface, with the degree of vacuum being adjustable to achieve an optimum braking effect. For accommodating sheets of different length the sheet brake 26 is secured to the frame 27 of the delivery mechanism by an adjustable bracket 28 which is adjustable in the direction of movement of the sheet.

Mounted so as to straddle the sheet receiving space 17 are a pair of tray supporting rails 30. Such rails (only one of which is shown) will be understood to be conventional, formed of angle iron with flanges, in lower position, extending mutually inwardly to provide a supporting shelf. Insertable into the tray support is a temporary pile board, more aptly referred to as a temporary receiving tray, 31, only one end of which is shown, the purpose of the receiving tray being the collection of downwardly settling sheets during the time that a filled pile board 23 is removed and replaced by an empty pile board.

During normal operation the top of the pile 20 is generally at a level at or above the rail type supports 30. Thus, in making a pile change it is necessary, first, to lower the pile so that the receiving tray 31 may be inserted into collecting position. Sheets continue to be delivered during this transition.

Accordingly, in carrying out the present invention, a buffer storage device is located in a position to intercept the sheets entering the receiving space 17, the device including a front edge support and a rear edge support, at least the rear edge support occupying a normal horizontal position but having a hinge mounting with means for applying a light counterbalancing force so that the sheets fed during the transition period are intercepted to provide a time delay for insertion of the tray, the rear edge support being so constructed that the accumulated weight of the first few sheets is sufficient to overcome the counterbalancing force so that the intercepted sheets, following the time delay, are automatically dumped as a group upon the tray.

In the illustrated embodiment the buffer storage device, indicated generally at 40, includes a front edge support 41 and a rear edge support 42. Such supports, it will be understood, extend into the plane of the drawing to form "shelves" for the buffer storage or a few sheets S along the leading and trailing edges thereof.

The front edge support 41 is mounted for reciprocating movement upon a plunger 43 of an actuator 44 which may, for example, be a pneumatic actuator secured to the frame 27 of the delivery mechanism and having advancing means 45. This enables the supporting member 41 to occupy the illustrated extended position when the buffer storage is active and a retracted position, shown in dot dash lines, during normal operation of the press between successive pile changes.

In accordance with one of the important aspects of the present invention the rear edge support 42 is of dog-leg profile made up of a series of laterally spaced hinged elements 50 (only one is shown) having a horizontal or supporting leg 51 and a generally vertical, or counterbalancing leg 52, with a pivot axis 53 between them. The pivot is supported in a vertically extending support member 55 having a mounting portion 56.

The leg 52 of the rear support member is longer than the horizontal leg 51, and in any event heavier than the later, to provide a slight torque, or moment, in the clockwise direction, resulting in the supporting member being biased upwardly with an extremely light biasing force indicated at F. A stop 57 effectively interposed in the path of upward movement of the supporting surface establishes a normal horizontal position for the rear edge support.

To understand the manner in which the rear edge support 42 is biased in the clockwise direction sufficiently to support the weight of several sheets S, reference may be made to FIG. 3. It will be noted that the individual supporting member 50 is so constructed, and its weight so distributed, as to provide a center of gravity 58 which lies slightly to the right of the pivot 53, resulting in a preload moment MP. The center of gravity shifts to the position 59 as the supporting member 50 is rocked in the direction of its dumping position illustrated in dot dash outline. The weight of the sheets pressing downwardly with a weight of W results in a counterclockwise moment MW. This is counterbalanced by a clockwise restoring moment MR due to the shifted center of gravity as the weight of the sheets is progressively increased.

When only three sheets S, say, are being supported, as illustrated in FIG. 2, the weight of the sheets is not sufficient to move the supporting element appreciably from its horizontal position. However, when another sheet or two are added, their accummulated weight increases the moment MW to the point where the member 50 rocks into its downwardly sloping position, shown dot-dash, resulting in automatic dumping of the sheets S, as a group, onto the receiving tray 31.

The time delay prior to the dumping of the sheets, while short, is precisely predetermined since the sheets arrive at an accurately determined constant rate and since a predetermined number of sheets is effective to cause the dumping action. This ensures that there will be enough time to lower the main pile and to insert the temporary receiving tray before the downward feeding of the sheets, onto the tray, resumes.

In accordance with one of the aspects of the present invention means are provided for the automatic extension and retraction of the front edge support 41 which supports the leading edges of the sheets. As will be appreciated by one skilled in the art, control of the advancing means 45 may be effected by a first normally closed switch 61 which detects the downward movement of the pile 20, leading to its removal and a normally closed switch 62, connected in series therewith, which detects the full insertion of the tray 31 into its receiving position. Under normal conditions, with sheets being directly deposited upon the pile 20, the pile will be in place and switch 61 will be open corresponding to the retracted condition of the actuator 44 and with the front edge support 41 occupying its retracted out of the way position. When the pile is lowered the switch 61 closes itself completing the circuit to the advancing means 45 resulting in extension of the front edge support to the illustrated position so that, in combination with the rear edge support 42, the next few sheets which are subsequently delivered will be intercepted. As stated, this provides a predetermined time delay for insertion of the receiving tray 31. Such insertion opens the switch 62 resulting in retraction of the support 41 either immediately or following a predetermined built-in time delay, while the weight of the rear edges of the sheets upon the support 42 produces the dumping action which has been illustrated in FIG. 3. If desired, the time delay which is incorporated in the control system may be such as will produce sequential release at the rear and front edges of the collected sheets, in that order, a matter well within the skill of the art.

In accordance with one of the further features of the invention the frame 55, 56 of the rear edge support 42 is mounted upon the sheet brake 26 so that when the sheet brake is adjusted in one direction or the other along the path of movement of the sheets, by adjustment of the bracket 28 upon which the sheet brake is mounted, to accommodate sheets of varying length, the rear edge support 42 is automatically and simultaneously subjected to the same adjusting movement. The net effect is that only one adjustment, rather than two, suffices to adapt the mechanism to sheets of different length.

In the mechanism as described above, the rear edge support 42 occupies a constant position with respect to the trailing edge of the sheet as long as the bracket adjustment 28 sets the sheet brake in an appropriate position. However, means may be optionally provided for retracting the rear edge support so that it is completely out of the way of a descending sheet under normal delivery conditions. This can be accomplished as shown in FIG. 4 which is a fragmentary view in which corresponding elements have been denoted by corresponding reference numerals with the addition of subscript a. Thus, the rear edge support **42*a* is mounted upon a plunger 43*a* of an actuator 44*a* which is connected in parallel with the actuator 44 at the other end of the sheet. Under conditions of normal delivery onto the pile the rear edge support 42*a* is retracted mutually away from the support 41 at the leading edge of the sheet. However, when the buffer storage device is active the supports 41, 42*a* are thrust toward one another into the working positions illustrated in FIG. 1**.

It will be apparent that the objects of the present invention have been amply fulfilled. The buffer storage device 40 intercepts those sheets which descend while the main pile 20 is being lowered for removal and while the temporary receiving tray 31 is being inserted into its receiving position. After a predetermined small number of sheets has been collected in the buffer storage device, the weight of such sheets results in the automatic dumping illustrated in FIG. 3 so that the intercepted sheets are deposited as a group upon the tray. With the front edge 41 withdrawn, subsequently deposited sheets will be allowed to fall upon the temporary receiving tray until the new pile board is in place, following which the temporary receiving tray may be quickly withdrawn so that depositing of sheets occurs directly upon the main pile and with the front edges of the sheets being aligned by front edge guide 25. The buffer device, while acting automatically and reliably, is nevertheless of highly simplified construction enabling the device to be economically installed in new press delivery mechanisms as well as in press delivery mechanisms already in the field.

While I prefer to counterbalance the rear edge support utilizing the effect of gravity bias upon a plurality of support members of dog-leg profile arranged side-by-side, it will apparent to one skilled in the art that the invention is not limited to use of gravity bias and, if desired, a light clockwise torque may be applied to each of the supporting members 50 by appropriately light torsion springs, a substitution well within the skill of the calling.

The purpose of switch 61 shown in FIG. 1 is to act as a detector to complete a control circuit whenever there is absence of the main pile. Such switch has been shown to illustrate function rather than specific structure and it will be understood by one skilled in the art that other functionally equivalent forms of detector may be substituted without departing from the invention such as a light beam to monitor the presence of the top portion of the pile to cause (a) opening of the control circuit when the pile is present and (b) closing of the circuit when the pile is lowered for removal.

I claim as my invention:

1. In a delivery mechanism of a sheet-fed printing press, a frame defining a delivery staion having a pile board, a chain-type conveyor having grippers for gripping the leading edges of sheets for conveyance seriatim to the delivery station, means for automatically releasing the sheets at the delivery station with the released sheets settling downwardly through a receiving space under the force of gravity to form a pile, a horizontal rail type tray support straddling the receiving space, a temporary receiving tray insertable into the tray support for temporarily collecting the downwardly settling sheets when a filled pile board is lowered for removal and replacement by an empty pile board, and a buffer storage device located immediately above the tray support for intercepting the sheets entering the receiving space when the pile board is lowered, the buffer storage device including a front edge support for supporting the front edge of a sheet and a rear edge support for supporting the rear edge of the sheet, at least the rear edge support occupying a normal horizontal position but having a hinge mounting and means for applying a light counterbalancing force so that the first few sheets fed following the lowering of the pile are intercepted providing a time delay for insertion of the tray but with the accumulated weight of the first few sheets being sufficient to overcome the counterbalancing force so that the intercepted sheets, following the time delay, are automatically dumped as a group upon the tray.

2. The combination as claimed in claim 1 in which there is mounted on the frame at the delivery station a sheet brake subassembly for engaging the underside of a released sheet to brake its forward velocity, the sheet brake subassembly being adjustably positionable along the path of conveyed movement of the sheet for accommodating the delivery mechanism to sheets of different length, the rear edge support of the buffer storage device being hinged to the sheet brake subassembly for simultaneous adjusting movement therewith.

3. The combination as claimed in claim 1 in which the rear edge support is of dog-leg cross section having a horizontal support leg and a generally vertical counterbalancing leg with a pivot axis between them.

4. The combination as claimed in claim 3 in which the counterbalancing leg is longer and weightier than the support leg.

5. The combination as claimed in claim 1 in which the front edge support is horizontally shiftable between an extended sheet-intercepting position and a retracted position permitting normal passage of a released sheet to the pile.

6. The combination as claimed in claim 1 or in claim 3 or in claim 4 in which the rear edge support is preloaded with a light biasing force in the upward direction but with a stop being effectively interposed in the path of upward movement to establish a normal horizontal position for said support.

* * * * *